US005360153A

United States Patent [19]

Cooper

[11] Patent Number: 5,360,153

[45] Date of Patent: Nov. 1, 1994

[54] ELECTRIC POWERED APPARATUS FOR DISPENSING INDIVIDUAL PLASTIC FASTENERS FROM FASTENER STOCK

[75] Inventor: William J. Cooper, Woonsocket, R.I.

[73] Assignee: Avery Dennison Corporation, Pasadena, Calif.

[21] Appl. No.: 61,703

[22] Filed: May 13, 1993

[51] Int. Cl.[5] ..... B65C 7/00

[52] U.S. Cl. ..... 227/67; 310/50

[58] Field of Search ..... 227/67; 173/117, 217, 173/170; 310/47, 50; 320/2

[56] References Cited

U.S. PATENT DOCUMENTS

| | | | |
|---|---|---|---|
| 3,525,912 | 8/1970 | Wallin | 310/50 |
| 4,355,977 | 10/1982 | Ota et al. | 310/50 |
| 4,709,201 | 11/1987 | Schaefer et al. | 320/2 |
| 4,835,410 | 5/1989 | Bhagwat et al. | 310/50 |
| 4,923,106 | 5/1990 | Furutsu | 227/67 |
| 4,971,238 | 11/1990 | Furutsu | 227/67 |
| 5,001,772 | 3/1991 | Holcomb et al. | 320/2 |

*Primary Examiner*—Scott A. Smith
*Attorney, Agent, or Firm*—Kriegsman & Kriegsman

[57] ABSTRACT

An apparatus for dispensing plastic fasteners from fastener stock includes a gun shaped casing. A hollow needle having an inlet opening is mounted on the casing. A guide groove is formed on the casing for receiving the fastener stock, the guide groove being in communication with the inlet opening in the hollow needle. A feeder element for intermittently advancing fastener stock loaded into the guide groove is mounted on the casing. An ejector rod is provided for pushing plastic fasteners from the fastener stock through and out of the hollow needle one at a time. The ejector rod and feeder element are driven by an electric motor powered by a battery pack removably mounted in the casing and which contains rechargeable batteries. The battery pack includes a receptacle which is arranged to enable the batteries to be recharged with the battery pack in or out of the tool. A converter assembly is provided for converting rotary motion of the drive shaft of the motor into linear motion of the ejector rod, the converter assembly including a worm on the drive shaft, a worm gear driven by the worm, a spur gear loosely coupled to the worm gear, a slider for holding the ejector rod and a rack driven by the spur gear and mounted on the slider. First and second single pole double throw switches are provided for controlling the operation of the electric motor so as to either cause rotation of the drive shaft in one direction, cause rotation of the drive shaft in the other direction or stop rotation of the drive shaft. The first switch is operated by a trigger which is pivotally mounted on the casing and the second switch is operated by an actuator mounted on a movable slide bar which is coupled by a link to the slider.

2 Claims, 14 Drawing Sheets

ELECTRIC POWERED APPARATUS FOR DISPENSING INDIVIDUAL PLASTIC FASTENERS FROM FASTENER STOCK

BACKGROUND OF THE INVENTION

The present invention relates to a new and improved apparatus for dispensing individual plastic fasteners from fastener stock.

Plastic fasteners of the type having a cross bar at one end, a paddle at the other end and a thin filament or cross-link connecting the two ends are well known in the art and widely used in commerce to attach labels, price tags or other items to articles in a manner which minimizes the risk of inadvertent detachment therefrom. Typically, such plastic fasteners are manufactured in the form of fastener stock, the fastener stock being produced by molding or stamping from flexible plastic materials, such as nylon, polyethylene, and polypropylene. In one known type of fastener stock, the cross bar end of each fastener is connected to a runner bar to form a clip of fasteners. In another known type of fastener stock, often referred to as ladder stock, a pair of elongated side members are interconnected by a plurality of cross links or filaments. One of the side members is shaped to define a plurality of cross bars which are joined together by short severable connectors, the connectors being defined by indentations or notches formed along the side member. The other side member is shaped to define a plurality of paddles.

Additional information pertaining to fastener stock may be obtained from the following commonly assigned U.S. patents, all of which are incorporated herein by reference: U.S. Pat. No. 4,955.475 issued Sep. 11, 1990; U.S. Pat. No. 4,456,161, issued June 26, 1984; U.S. Pat. No. 4,121,487, issued Oct. 24, 1978; U.S. Pat. No. 3,470,834, issued Oct. 7, 1969 and U.S. Pat. No. 3,103,666, issued Sep. 17, 1963.

The dispensing of individual fasteners from fastener stock is often accomplished with an apparatus commonly referred to as a "tagger gun". Typically, a tagger gun is a hand held trigger operated gun shaped device which is constructed to accept fastener stock and which includes a mechanism for feeding the cross bar end of a fastener into a hollow needle at the front end of the gun and a mechanism for pushing the cross bar end of the fastener that has been fed into the hollow needle out through the tip of the hollow needle.

In commonly assigned U.S. Pat. No. 5,024,365, which issued Jun. 18, 1991 and which is herein incorporated by reference, a tagger gun for dispensing a plastic fastener through a slotted hollow needle from continuously connected fastener stock is described. The apparatus includes an actuator slide with a central channel, the actuator slide being secured to an ejector rod and fastener stock feed mechanism to actuate these functions. The apparatus further includes a shuttle assembly which reciprocates transversely to the needle axis to cause the cutting of a fastener from the fastener stock, and transport of the severed fastener to the needle axis. The cam bar is linked to the shuttle mechanism and pivotally mounted so that the pivoting of the cam bar causes the transverse shuttle motion. The cam bar passes through the actuator slide channel, whereby sliding of the actuator slide causes pivoting of the cam bar according to the profile of the cam. The apparatus, further includes an antiback mechanism in the form of a catch lever which engages the trigger when it has been partially depressed and prevents its release, until the trigger has been fully depressed.

In commonly assigned U.S. Pat. No. 4,456,161, which issued June 26, 1984, another tagger gun for dispensing fasteners is described. The apparatus comprises a casing, a fastener dispensing hollow slotted needle mounted on the casing, means for advancing a fastener to a position adjacent the rear of the needle bore with its end-bar transversely disposed to the longitudinal axis of the bore, means for aligning the end-bar with the needle bore, and means for dispensing the end-bar through the bore. Preferably, the apparatus comprises a feed wheel, an aligning means comprising a reciprocating cam slide which also actuates the feed wheel, a dispensing means comprising a plunger carried by a reciprocating support which also actuates the cam slide, and means for reciprocating the support.

In U.S. Pat. No. 4,971,238 which issued on Nov. 20, 1990, there is disclosed a tagger gun type apparatus in which the transverse bar of a tag pin is pushed out of a hollow needle by a piston which is driven by a motor. The motor is coupled to the piston by a rack and pinion and is controlled by a circuit which includes three switches and other componentry.

In commonly assigned U.S. Pat. No. 3,470,834, which issued Oct. 7, 1969, there is disclosed an apparatus for dispensing fasteners which comprises a casing, a needle projecting from the casing, the needle having a central bore, and a plunger slidable back and forth in the bore, the needle comprising an elongated piece of sheet material bent into a tube with its edges spaced apart to provide a longitudinal slot along one side of said bore, the forward end of the needle being pointed and the rearward end having a tail for securing the needle in the aforesaid casing, the diameter of said bore being slightly larger than that of said bar so that the bar may slide lengthwise in the needle with said filament extending through said slot, and the device having a fastener passageway in advance of said plunger when the plunger is retracted.

In commonly assigned U.S. Pat. No. 4,121,487 which issued on Oct. 24, 1978 there is disclosed an apparatus for dispensing fasteners which includes a stepper motor.

In commonly assigned U.S. Pat. No. 3,103,660 issued on Sept. 17, 1963 there is described a tagger gun type apparatus for attaching tags to fabrics with a bar-lock attachment, the apparatus being adapted for utilizing plural assemblies of bar-lock attachments and comprising a hollow needle elongately slotted along one side, a plunger for driving the bar of a bar-lock attachment through the needle with the filament of the attachment projecting through the slot, feeding means for bringing each of an assembly of bar-lock attachments into register with one end of the needle, knife means for severing an attachment which is in register with the needle from an assembly of attachments, and handle means for supporting the needle, the handle means including means for operating the feeding means, the knife means and the plunger in sequence.

Another known tagger gun is the Taggetron 770, an electric powered rechargable apparatus marketed by Central Notion Co., Inc. of Brooklyn, N.Y. Still another known tagger gun is the Taggetron 880, a modification of the Taggetron 770.

SUMMARY OF THE INVENTION

It is an object of the present invention to provide a new and improved apparatus for dispensing plastic fasteners from fastener stock.

It is another object of the present invention to provide an apparatus as described above which includes an ejector rod for pushing individual plastic fasteners out through a hollow needle and an electric motor for driving the ejector rod.

It is still yet another object of the present invention to provide an apparatus as described above which has a minimal number of parts, is extremely fast, is easy to assemble, is inexpensive to manufacture, and will not have a tendency to break or jam.

It is a further object of this invention to provide an apparatus as described above which includes a new and novel battery pack for powering the electric motor.

An apparatus for dispensing plastic fasteners from a clip of fastener stock constructed according to the teachings of this invention includes a casing, a hollow needle mounted at a front end portion of said casing, said hollow needle having an inlet opening for receiving the cross bar end of a fastener to be dispensed, a guide groove in said casing for receiving the fastener stock, said guide groove being in communication with said inlet opening in said hollow needle, a feeder element for intermittently advancing the fastener stock loaded into said guide groove so that the cross bar of the fastener to be dispensed is loaded into said hollow needle, an ejector rod for pushing the cross bar loaded into the hollow needle through and out of the tip of hollow needle, an electric motor for driving said ejector rod and said feeder element, said electric motor having a drive shaft, a converter assembly for converting rotary motion of the drive shaft of said electric motor into linear motion of said ejector rod, and control means for controlling the operation of said electric motor so as to produce intermittent reciprocating linear movement of said ejector rod.

According to one feature of the invention the converter assembly includes a worm mounted on the drive shaft of the electric motor, a slider, a rack mounted on the slider, a worm gear in engagement with the worm and a spur gear in engagement with the rack and coupled to the worm gear, the converter assembly being constructed so as to provide for overtravel.

According to another feature of the invention the control means includes a pair of switches constructed and arranged so as to collectively operate to either cause rotation of the drive shaft of the electric motor in one direction, cause rotation of the drive shaft of the electric motor in the other direction or stop rotation of the drive shaft of the electric motor.

According to still another feature of the invention the electric motor is powered by a removable battery pack. The battery pack includes the rechargeable batteries and is constructed so that the batteries can be recharged while the battery pack is either in or removed from the casing.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
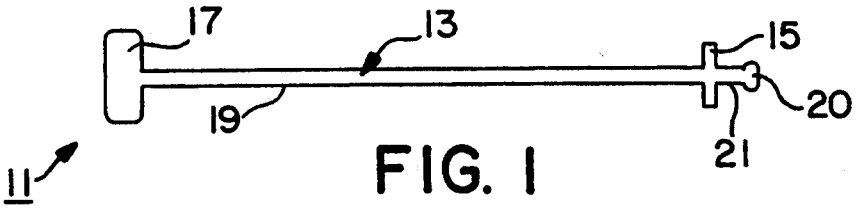
Figs. 1 and 2 are side and front views, respectively, of a clip of fastener stock which may be used with the apparatus of this invention.
Figure 2:
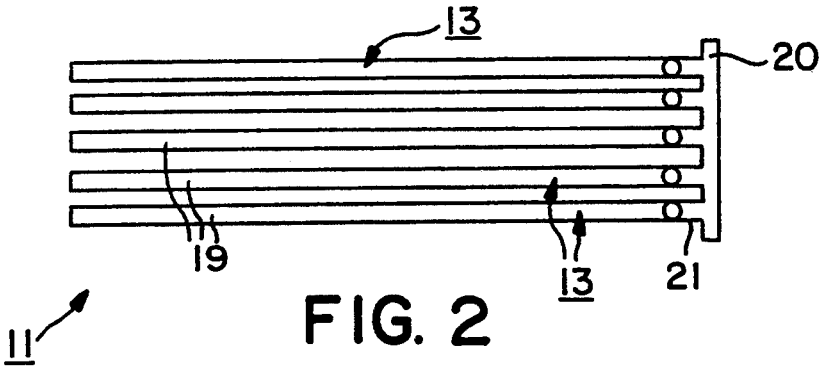

Referring now to the drawings, there is shown in FIGS. 1 and 2 side and front views, respectively, of a length of one type of known fastener stock, the fastener stock being identified by reference numeral 11. As can be seen, fastener stock 11 includes a plurality of individual fasteners 13, each having a cross bar 15 at one end, a paddle 17 at the other end and a thin filament 19 connecting the two ends. Each fastener 13 is coupled to a common runner 20 through a short connector filament 21 at the cross bar end of the fastener 13. Clip 11 is made of a plastic such as nylon, polyethylene or polypropylene.

Figure 3:
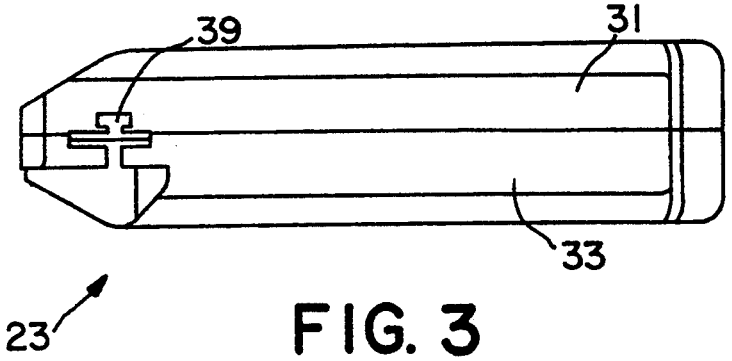
FIGS. 3 and 4 are side and top views, respectively, of an apparatus constructed according to this invention for dispensing plastic fasteners using the clip of fastener stock shown in FIGS. 1 and 2.
Figure 4:
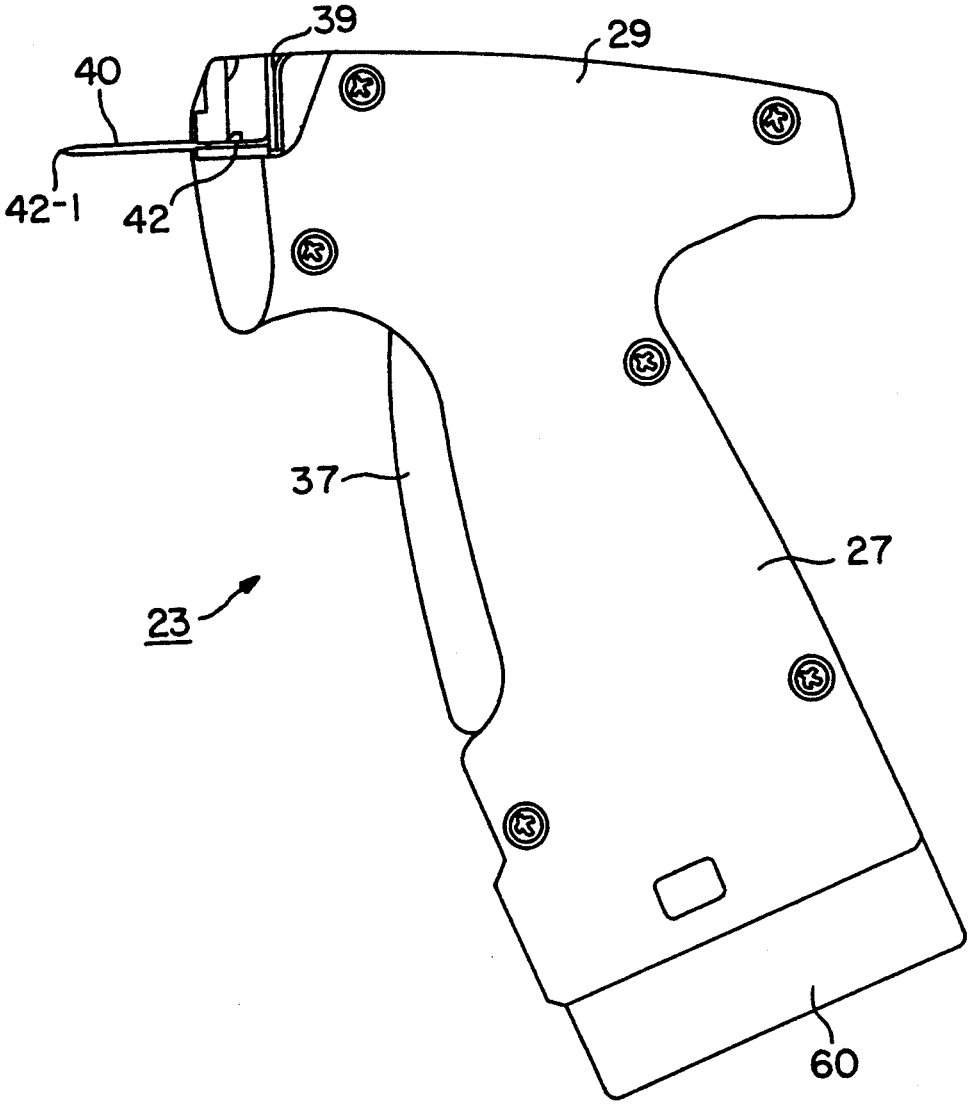
Figure 5:
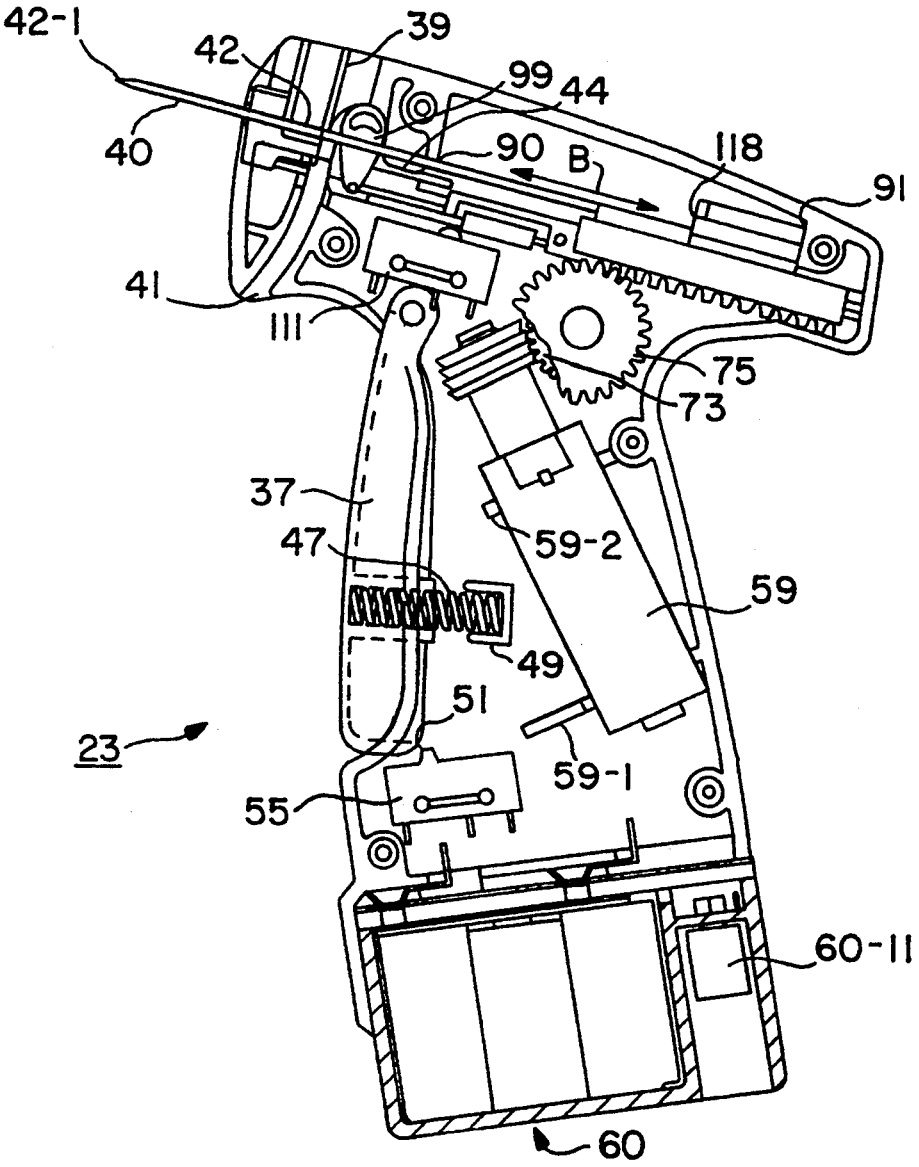
FIG. 5 is a view broken away in part illustrating the internal construction of the apparatus shown in FIGS. 3 and 4.
Figure 5A:
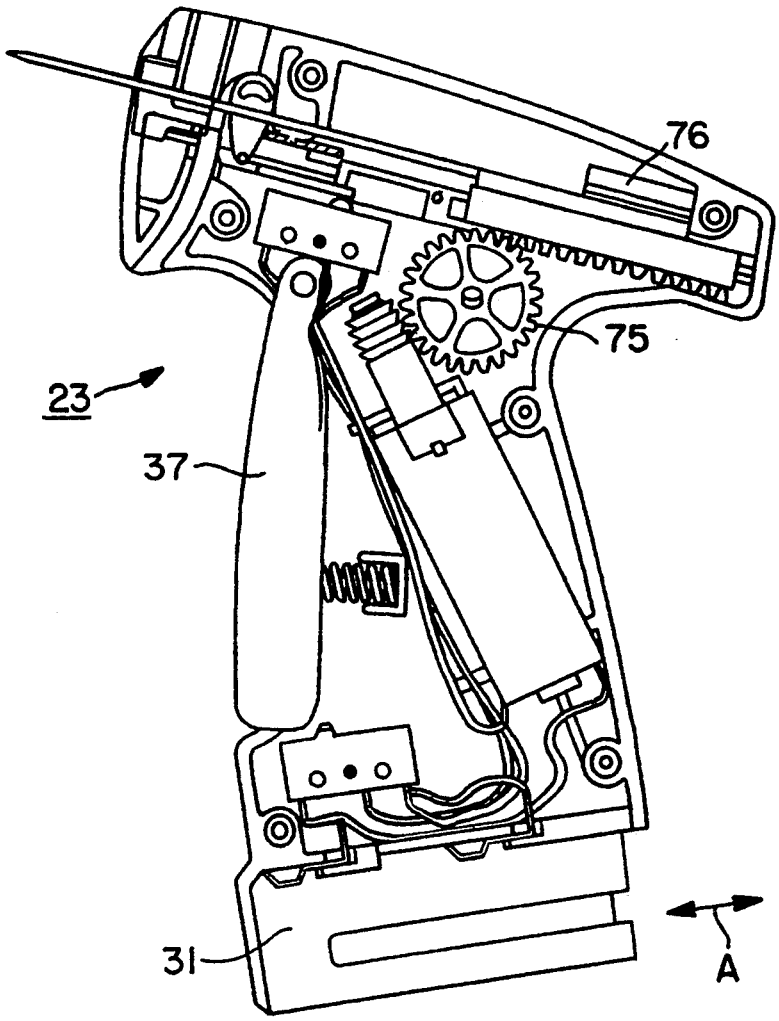
FIG. 5A is a perspective view of the apparatus as shown in FIG. 5 without the battery pack and the link connecting the slide bar to the feeder element.

Referring now to FIGS. 3 and 4., there is shown side and top views, respectively, of an apparatus constructed according to this invention for dispensing plastic fasteners 13 from fastener stock 11, the apparatus being identified by reference numeral 23. The internal structure of apparatus 23 is shown in FIGS. 5, 5A and 6A through 6F.

Apparatus 23 includes a hollow gun-shaped casing 25 having a handle portion 27 and a barrel portion 29. Casing 25 is formed of a right half 31 and a left half 33. Halves 31 and 33 may be fabricated from any convenient material, such as molded plastic and are joined together by screws 35. Alternatively, halves 31 and 33 may be joined together by a snap-fit, by sonic welding, by gluing, by riveting or the like. Apparatus 23 is hand actuated by a lever type trigger 37 located at the front of handle portion 27. A guide groove 39 is formed in the top of barrel portion 29 into which fastener stock 11 is inserted. A hollow needle 40 is removably mounted at the front end 41 of barrel portion 29. Needle 40 includes an inlet opening 42 for receiving the cross bar 15 of a fastener 13. In the operation of apparatus 11, the cross bar 15 of the fastener 13 to be dispensed is fed into needle 40 through inlet opening 42 and is then pushed out through the tip 42-1 of needle 42 as will hereinafter be described. Needle 40 includes a knife edge 43 at the back which serves to separate a fastener 13 from the fastener stock 11 as it is fed into hollow needle 40. An antiback 44 is pivotally mounted on a pin 45 on casing 25 to prevent fastener stock 11 from backing up in guide groove 39 up during the feed operation.

Trigger 37 is pivotally mounted on a pivot pin 46 integrally formed on right half 31 of casing 25. Trigger 37 is held biased outward by a compression spring 47 sandwiched between a U shaped rib 48 formed in handle portion 27 and a U shaped rib 49 formed in right half 31 of casing 25. When trigger 37 is pushed in, projection 51 will hit up against and push in button 53.

An ejector rod 57 is provided for pushing cross bars 15 of fasteners 13 out through hollow needle 41, one at a time. Ejector rod 57 is driven by a DC motor 59 which is mounted on supports 59-1 and 59-2 integrally formed on right half 31 of casing 25. DC motor 59 is powered by a removable battery pack 60.

Battery pack 60 includes a set of batteries 60-1, 60-2 and 60-3 which are disposed inside a generally box shaped container 60-4 having a bottom wall 60-5 and an open top 60-6, a spacer 60-7, a pair of terminals 60-8 and 60-9, a cover plate 60-10 and a switch type charging receptacle 60-11. Battery pack 60 is slidably mounted into casing 25 from the side as shown by arrows A in FIG. 5A. A flexible tab 60-12 on container 60-4 holds battery pack 60 in place in casing 25. Charging receptacle 60-11 is accessed through an opening 60-13 extending in from bottom 60-5. Charging receptacle 11 includes a normally closed negative terminal 60-14, a fixed negative terminal 60-15 and a fixed positive terminal 60-16.

Figure 6A:
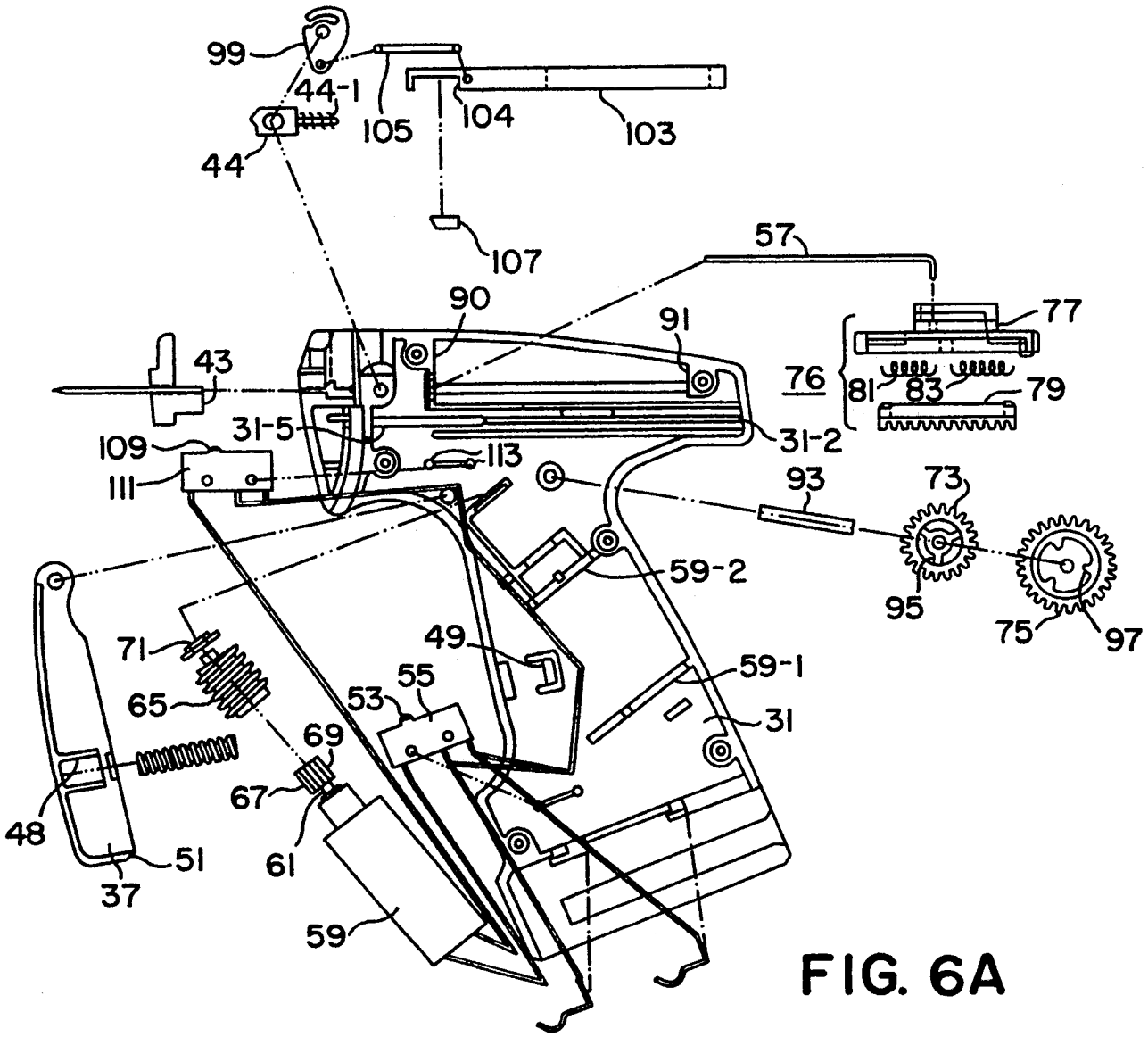
FIG. 6A and 6B taken together are an exploded view of the apparatus shown in FIGS. 3 and 4.
Figure 6B:
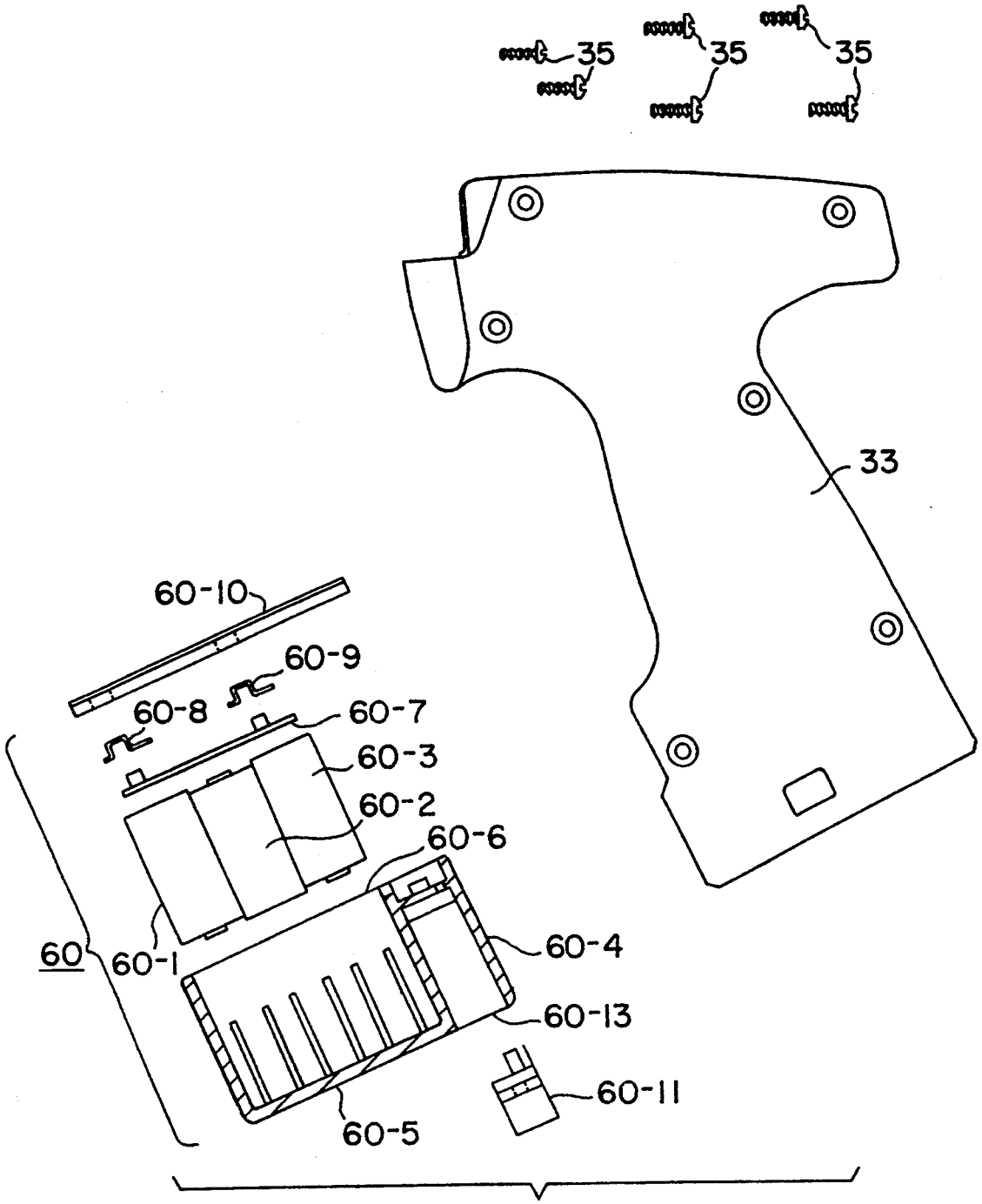
Figure 6C:
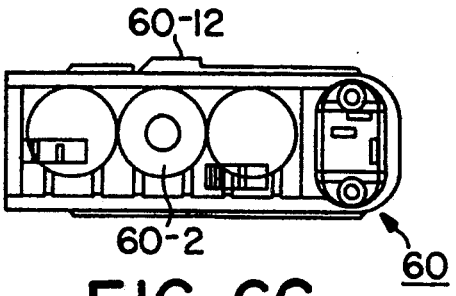
FIGS. 6C, 6D and 6E are bottom, right side and perspective views, respectively of the battery pack in FIG. 5.
Figure 6D:
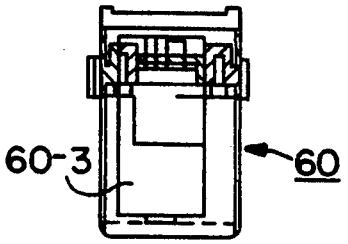
Figure 6E:
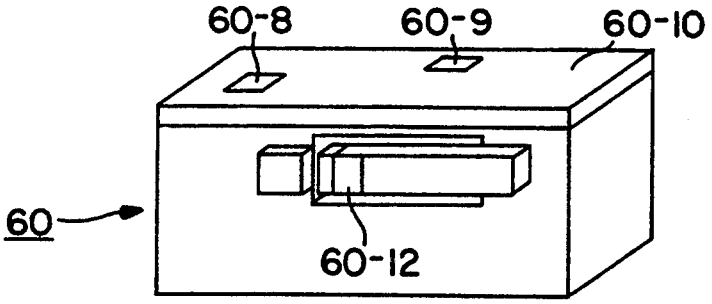
Figure 6F:
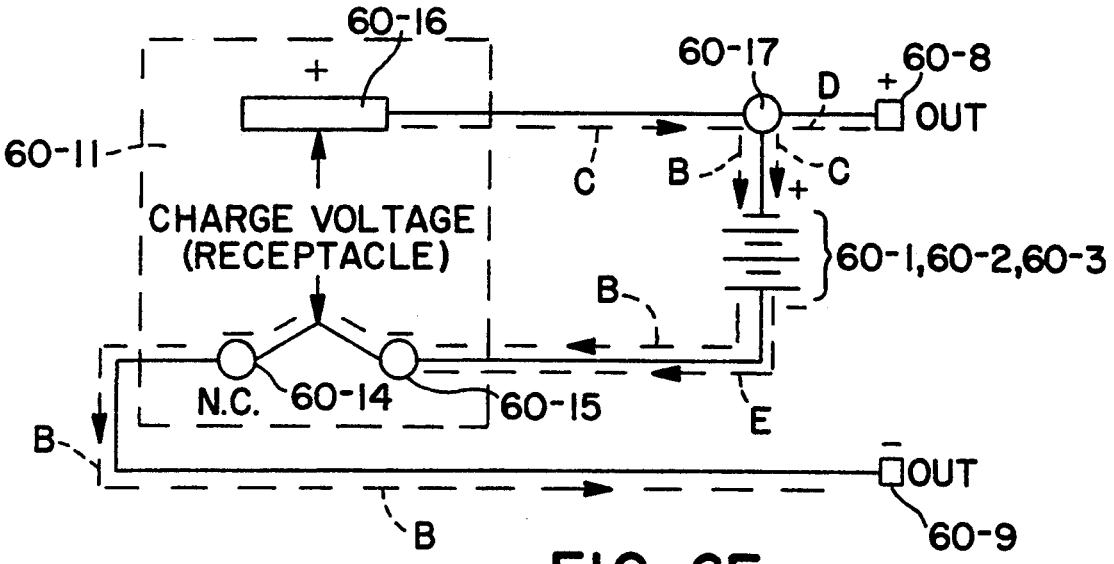
FIG. 6F is a circuit diagram for the battery pack shown in FIG. 5.

A circuit diagram for battery pack 60 is shown in FIG. 6F.

When battery pack 60 is not being charged i.e. the plug of a charging device (not shown) is not inserted into charging receptacle 60-11, terminal 60-14 is closed and batteries 60-1, 60-2 and 60-3 will be coupled in to output terminals 60-8 and 60-9 through junction 60-17 on one side and contacts 6-14 and 60-15 on the other side as shown by dashed lines B. When the plug of a charging device is inserted into receptacle 60-11, normally closed negative contact 60-14 will be pushed open and batteries 60-1, 60-2 and 60-3 will be coupled to the charging device through a path including positive terminal 60-16 and junction 60-17 on one side and negative terminal 60-15 on the other side as shown by dashed lines C. Batteries 60-1, 60-2 and 60-3 will not be coupled to output terminals 60-8 and 60-9.

As can be appreciated, battery pack 60 can be recharged either while it is in casing 25 or is removed from casing 25.

Figure 7:
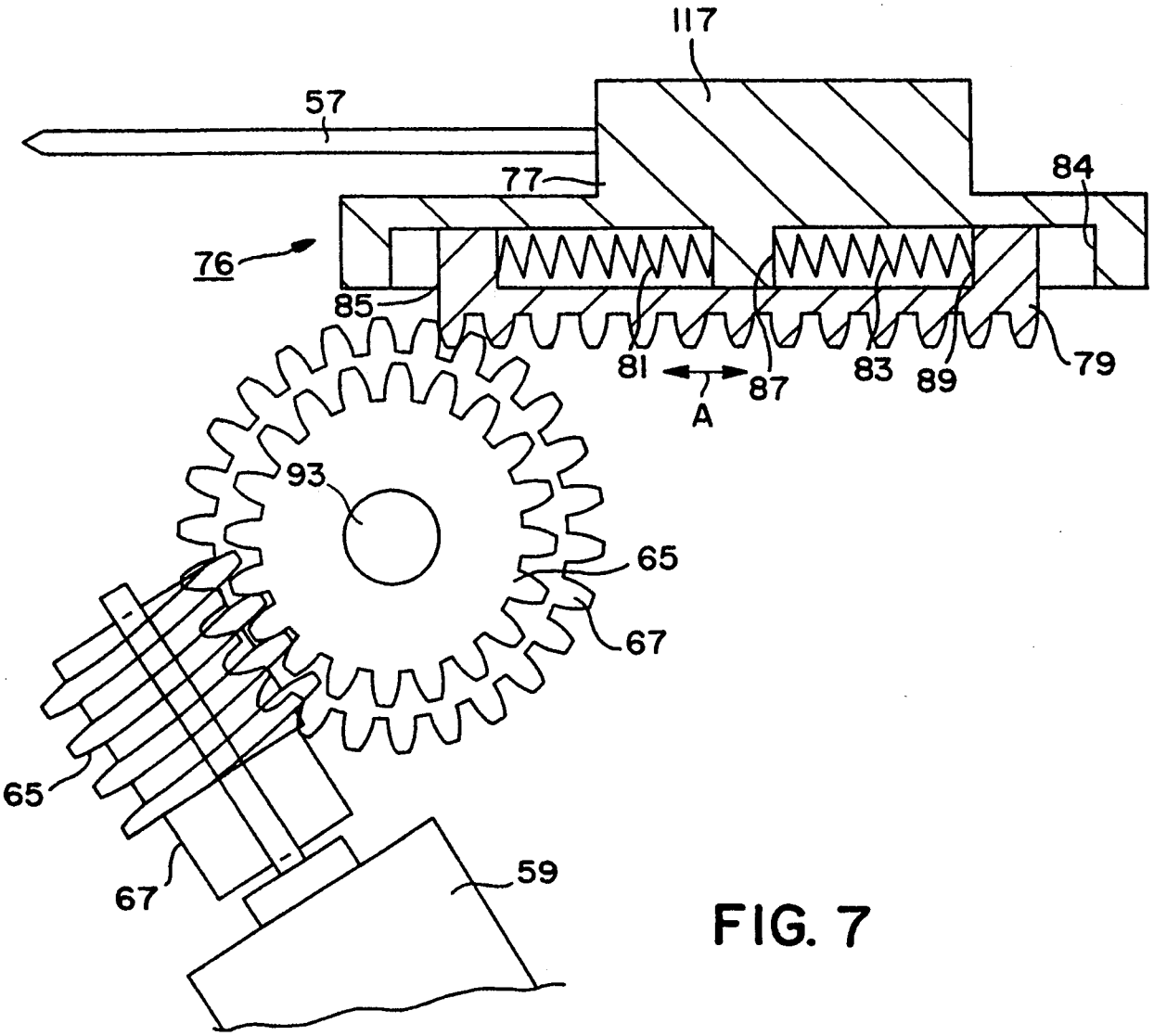
FIG. 7 is an enlarged pictorial view of the converter assembly ejector rod and DC motor shown in FIGS. 5 and 6.
Figure 8:
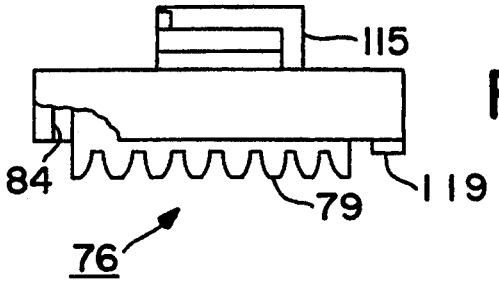
FIGS. 8, 9, 10 and 11 are front, top side and bottom views, respectively, of the slider assembly shown in FIGS. 5 and 6, FIG. 10 being broken away in part.
Figure 9:
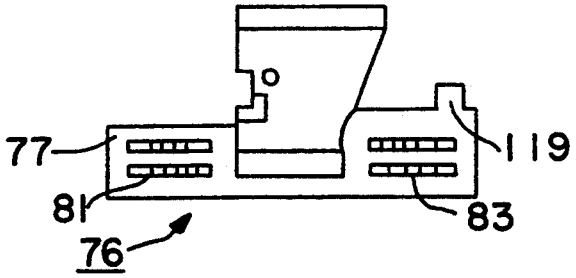
Figure 10:
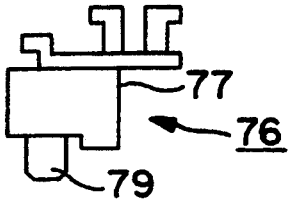
Figure 11:
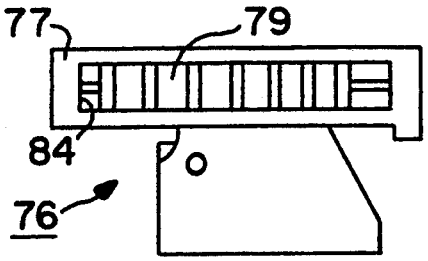
Figure 12:
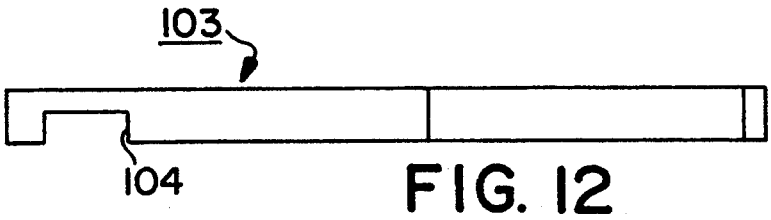
FIG. 12, 13 and 14 are front, top and side views, respectively, of the slide bar shown in FIGS. 5 and 6.

Rotation of the drive shaft 61 of DC motor 59 is converted into linear movement of ejector rod 57 by a converter assembly 63. Rotation of drive shaft 61 is reversed to produce reciprocating linear movement of ejector rod 57 as will be later described. An enlarged pictorial view of converter assembly 63, ejector rod 57 and DC motor 59 is also shown in FIG. 7.

Converter assembly 63 includes a worm 65 fixedly mounted on a spline 67 attached to the front end 69 drive shaft 61 of DC motor 59 and held in place by a bushing 71, a worm gear 73 in engagement with worm 65, a spur gear 75 in engagement with worm gear 73 and a slider assembly 76. Separate views of slider assembly 76 are also shown in FIGS. 8 through 11. Slider assembly 76 includes a slider 77, a rack 79 and a pair of compression springs 81 and 83. Ejector rod 57 is mounted on slider 77. Rack 79 is snap-fit into a recess 84 in slider 77. Rack 77 is slidably movable in recess 84 in slider 77 as shown by arrows A in FIG. 7 and is in engagement with spur gear 75 unless disengaged as will hereinafter be explained. Slider 77 is mounted in casing 25 for slidable movement back and forth within barrel portion 29 as shown by arrows B in FIG. 5. Movement of rack 79 in slider 77 is restricted by compression springs 81 and 83. Compression spring 81 is disposed inside rack 79 between a stop 85 at the front end of rack 79 and a center post 87 on slider 77. Compression spring 83 is disposed inside rack 79 between a stop 89 at the rear end of rack 79 and center post 87.

Forward movement of slider 77 in casing 25 is limited by a front stop 90 integrally formed in right half 31 of casing 25 while rearward travel of slider 77 is limited by a rear stop 91 formed in right half 31 of casing 25. In order to prevent jamming of the gears at each end of travel of slider 77, rack 79 is sized to provide for overtravel. In particular, the number of teeth and length of rack 79 is such that rack 79 will disengage from spur gear 75 (i.e. run out of teeth) at the end of its travel in each direction. Momentum will cause continued movement of rack 79 within slider 77, independent of spur gear 75. Reengagement of rack 79 with spur gear 75 is achieved by compression springs 83 and 85 as will also hereinafter be explained in more detail.

Worm gear 73 and spur gear 75 are each rotably mounted on a shaft 93 which is fixedly mounted in right half 31 of casing 25. Worm gear 73 is located behind spur gear 75. For clarity, spur gear 75 is broken away partly in FIG. 5 to show worm gear 73. Worm gear 73 and spur gear 75 are coupled together for movement by a set of splines 95 integrally formed on the front side of worm gear 73 and which face and interlock in a loose manner with a set of splines 97 integrally formed on one side of spur gear 75. The loose interconnection of worm gear 73 to spur gear 75 allows for overtravel of worm gear 73 relative to spur gear 75. This overtravel enables motor 59 to drive spur gear 75 to a high speed very quickly and with very little torque. The overtravel is realized by sizing and spacing the splines on each gear so worm gear 73 will have to rotate at least a few degrees in either direction before its splines hit up against the splines in the spur gear 75 and cause spur gear 75 to rotate with it.

A reciprocating feed pawl 99 for advancing fastener stock 11 loaded into guide groove 39 is rotably mounted on pin 45 in front of antiback 44. Feed pawl 99 is driven by a slide bar 103 which is coupled to feed pawl 99 by a link 105. Slide bar 103 is disposed within barrel portion 29 and movable back and forth by slider 77. An actuator 107 is disposed in a recess 104 in slide bar 103 for depressing a button 109 on a second switch 111 which is mounted on pins 113 integrally formed on right half 31 of casing 25. Slide bar 103 includes a recess 103-1 having a front wall 103-2 and a back wall 103-3. Slider 77 includes a projection 77-1 which is used to move slider 103. Actuator 107 is sized smaller than recess 104 so that it can move back and forth a small amount in recess 104 to provide for additional overtravel.

Figure 13:
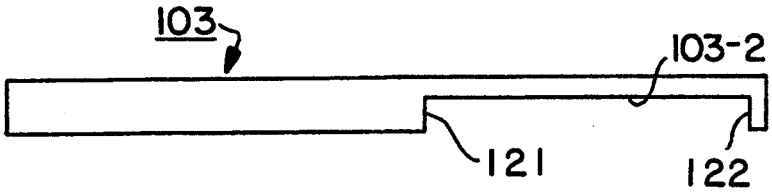
Figure 14:
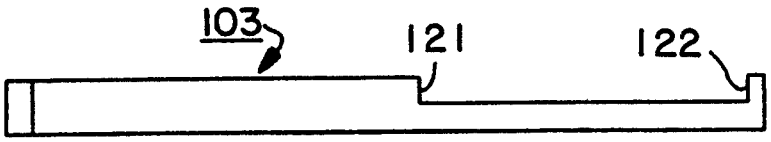
Figure 15A:
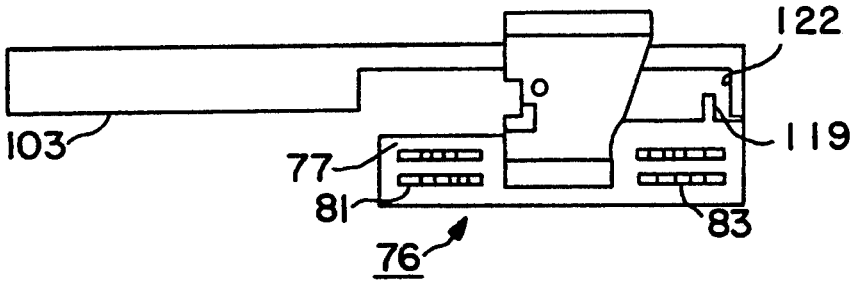
FIG. 15A is a simplified top view of parts of FIG. 15.
Figure 15:
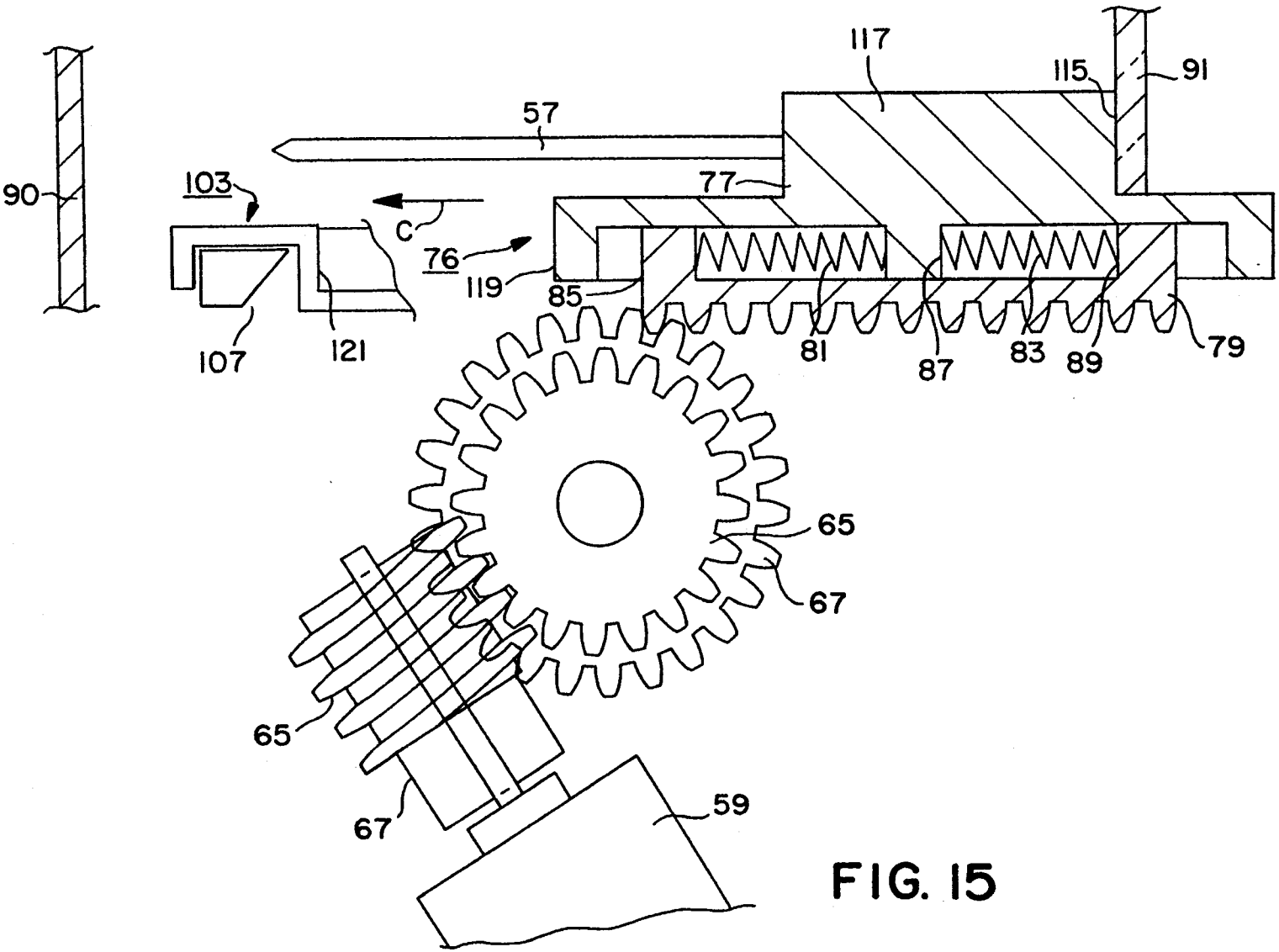
FIG. 15 is a fragmentary view of a portion of the internal structure of the apparatus of this invention.

When the mechanism in gun 23 is at rest in a "home" position, as shown in FIG. 15, rear end 115 of top projection 117 of slider 77 is abutting rear stop 91 in casing 25. As drive shaft 61 of DC motor 69 rotates clockwise slider 77 is moved in a forward direction as indicated by arrow C in FIGS. 15 and 15A. When projection 119 on slider 77 comes into contact with front projection 121 on slide bar 103 it will cause slide bar 103 to also advance in a forward direction causing feed pawl 99 to rotate about pin 101 in a forward direction, pushing fastener stock 11 down into guide groove 25. Slider 77 will move forward until front end 119 hits front stop 90. Rotation of drive shaft 61 in a counterclockwise direction will cause slider 77 to return to its original position. As slider 77 moves back, projection 119 will hit up against rear projection 122 on slide bar 103, see FIGS. 13 and 14, and carry slide bar 103 back with it to its original position.

Figure 16:
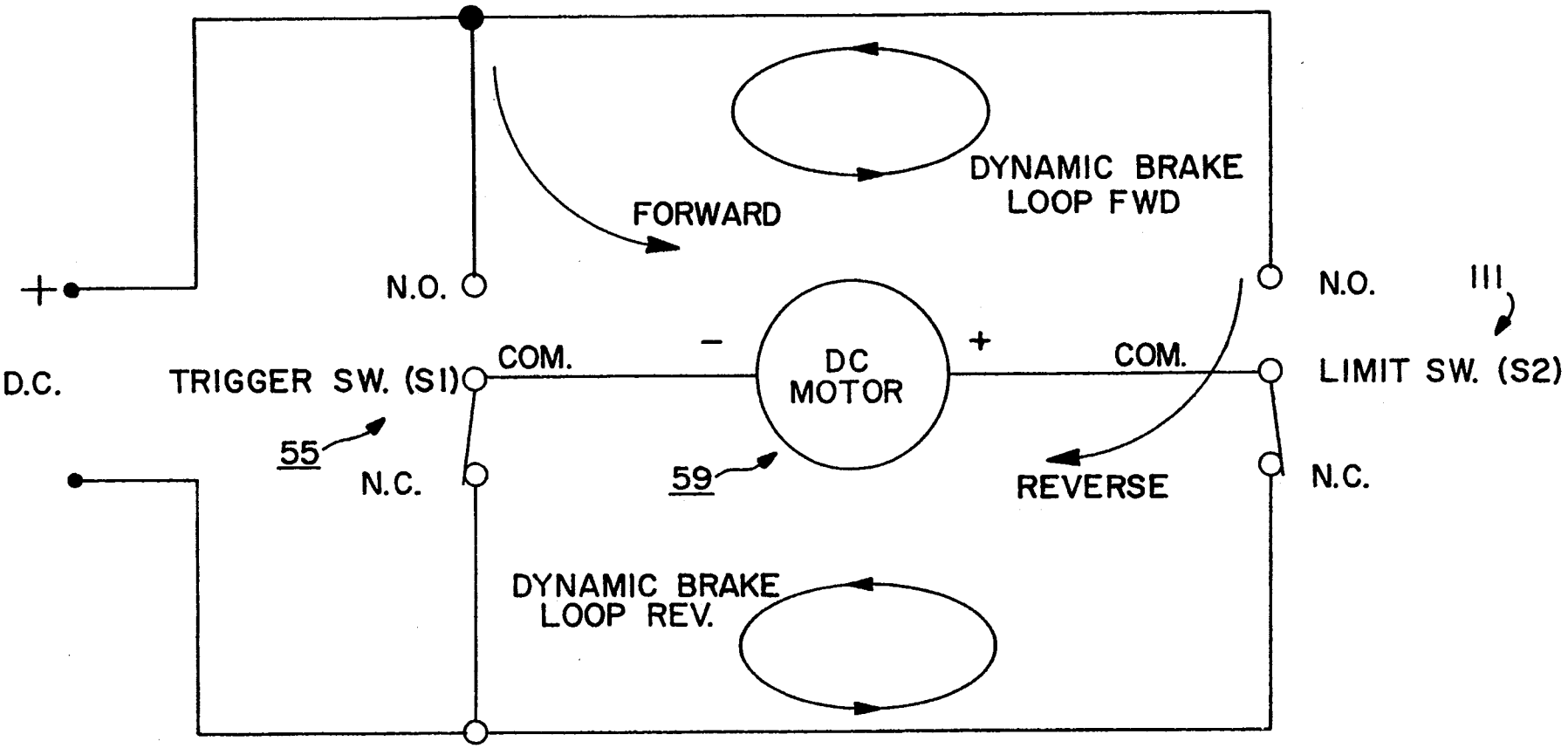
FIG. 16 is a circuit diagram of the electrical portion of the apparatus of this invention.

The operation of the electric circuit portion of apparatus 23 can be best understood with reference to FIG. 16.

As can be seen, the electric circuit comprises first switch 55, DC motor 59 and second switch 111. First switch 55 and second switch 111 are both normally closed, single pole, double throw switches. The common terminal 55-1 of switch 55 is connected to the negative terminal of DC motor 59 while the common terminal 111-1 of switch 111 is connected to the positive terminal of DC motor 59.

With switches 55 and 111 in their normally closed position there is no current flowing through DC motor 59. When trigger 37 is squeezed, projection 51 at the bottom of trigger 37 will depress button 53 on first switch 55 causing switch 55 to move from a normally closed position to a normally open position. This will cause current to flow through DC motor 59 in a path shown by dashed lines 113. This current flow through DC motor 59 will cause shaft 61 of motor 59 to rotate in a clockwise direction which in turn will cause slider 77 to move in a forward direction toward the front end of barrel portion 29, eventually engaging and carrying with it slide bar 103.

Just before slider 77 hits stop 90, detent 107 on slide bar 103 will push down against and depress the actuator button 115 on switch 111 causing switch 111 to move from a normally closed state to a normally open state.

At the same time as slider 77 hits stop 90, the last tooth 79-1 on rack 79 will be in engagement with spur gear 75. Continued movement of rack 79 in a forward direction, will be free movement since rack 77 is no longer coupled to spur gear 75. This movement will compress spring 81. Since spring 81 is a compression spring it will tend to reextend pushing rack 79 back to its position prior to any free movement so that the first tooth on rack 79 is reengaged with spur gear 75.

With switch 55 in an open position and switch 111 in an open position there will be a dynamic braking loop which will quickly bring motor 59 to a stop.

Upon release of trigger 37, switch 55 will return to a normally closed position and current will flow through motor 59 in a path shown by dashed arrows 117 causing drive shaft 61 of motor 59 to rotate counterclockwise. This in turn will cause slider 77 to return to its original "home" position carrying with it slide bar 103. As slide bar 103 moves back it will release switch button 109 returning switch 111 to a normally closed position. Slider 77 will stop when it hits rear stop 71. Momentum will cause continued free movement of rack 79. Compression spring 83 will push rack 79 back into engagement with spur gear 75.

Instead of being one single pole double throw switch, switch 55 could be a pair of single pole single throw switches, one normally open and the other normally closed, with both switches being mechanically ganged together. Switch 111 could also be a pair of single pole single throw switches constructed and coupled together in the same way.

Instead of shortening the rack to disengage the motor and drive gear from the slider at the end of its limited travel, overtravel can be achieved removing an arcuate segment of teeth from the spur gear or by providing for alternate engagement and disengagement of the spur and worm gears radially at a common pressure point using a spring loaded projection on one of the gears and a detent on the other gear.

Figure 17:
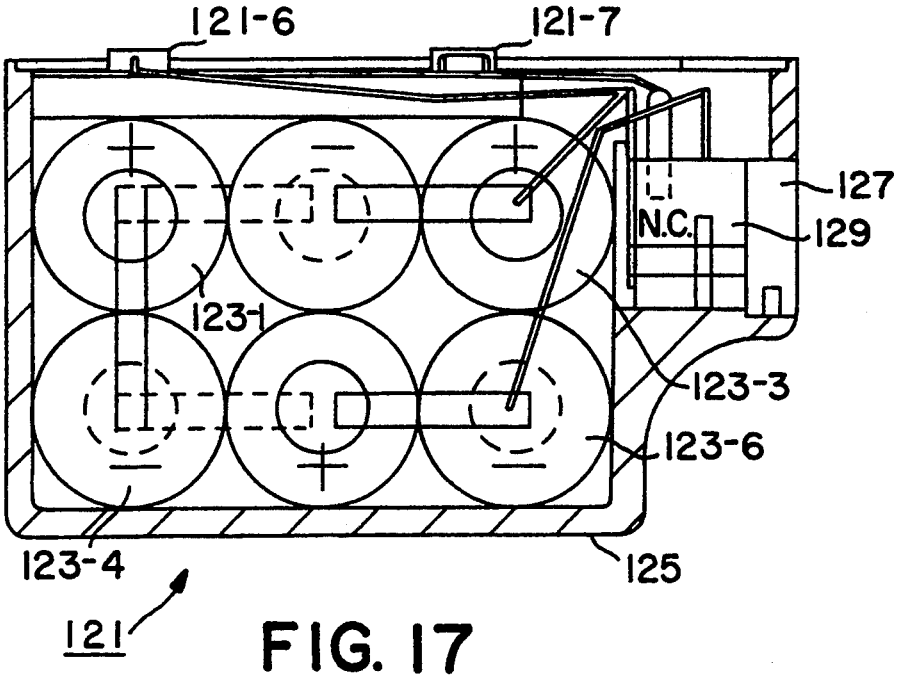
FIGS. 17, 18 and 19 are front section, top and side views of another embodiment of the battery pack used in the apparatus.
Figure 18:
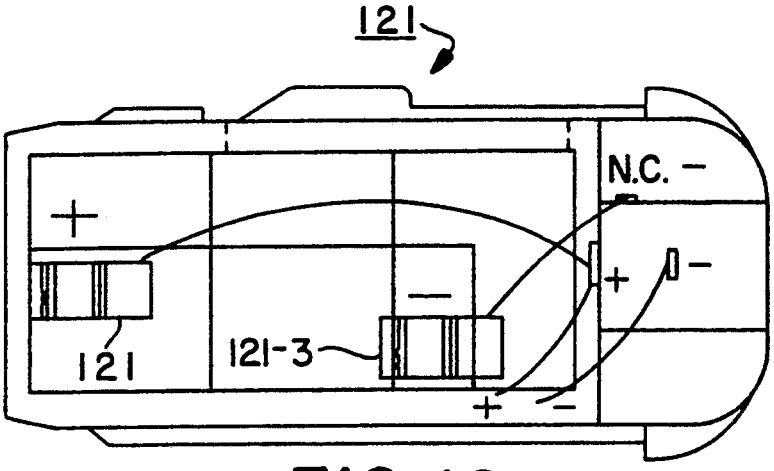
Figure 19:
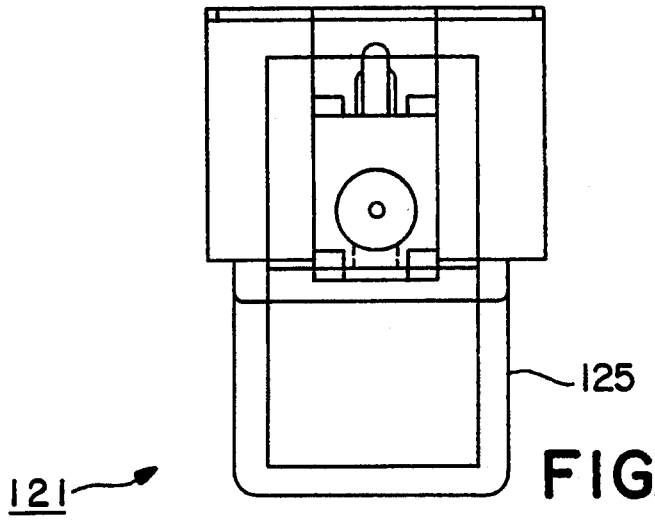
Figure 20:
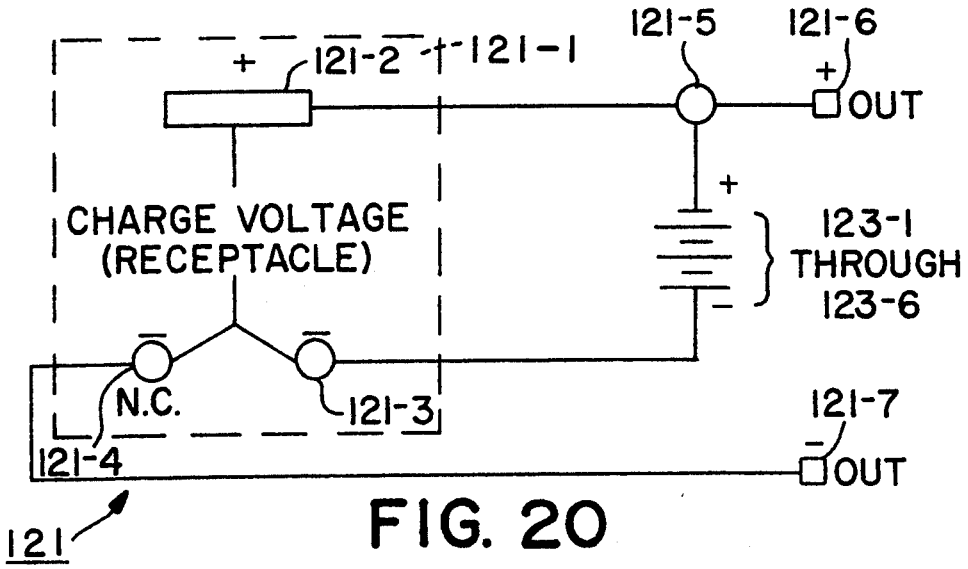
FIG. 20 is circuit diagram for the battery pack in FIG. 17.

In FIGS. 17–19 are shown front, top and side views of a modification of battery pack 60, the modification being identified by reference numeral 121. Battery pack 121 includes 6 batteries 123-1 through 123-6 which are stacked horizontally rather than vertically. Battery pack 121 includes a container 125 having an opening 127 in the side in which is disposed a charging receptacle 129. The circuit diagram for battery pack 121 is shown in FIG. 20. The circuit includes a switch type charge voltage receptacle 121-1 having a positive terminal 121-2, a fixed negative terminal 121-3 and a normally closed terminal 121-4, a function 121-5, output terminals 121-6 and 121-7. Circuit 121 operates the same way as in battery pack 60. Battery pack 121 is accessed for charging through opening 127.

The embodiments of the present invention described above are intended to be merely exemplary and those skilled in the art shall be able to make numerous variations and modifications to it without departing from the spirit of the present invention. All such variations and modifications are intended to be within the scope of the present invention as defined by the appended claims.

What is claimed is:

1. Apparatus for dispensing fasteners from fastener stock comprising:

a. a casing, b. a mechanism in the casing for ejecting fasteners loaded into the casing, c. an electric motor for driving said mechanism, and d. a battery pack for powering said electric motor, said battery pack being removably mounted in said casing and including:

i. a container, ii. at least one rechargeable battery in said container, iii. terminals on said container for electrically coupling said at least one battery to said electric motor, and iv. a charging receptacle in said container and electrically coupled to said at least one battery, said charging receptacle containing a plug operated switch, said plug operated switch being constructed for operation with a DC charging device and being located in said container such as to be accessible for connection to said DC charging device when said battery pack is mounted in said casing and removed from said casing, said charging receptacle including a normally closed terminal of one polarity, a first fixed terminal of the same polarity as said normally closed terminal and a second fixed terminal of the opposite polarity of said first fixed terminal contained therein.

2. The battery pack of claim 1 wherein said normally closed terminal is of negative polarity.

* * * * *